US005590541A

United States Patent [19]

Rainwater

[11] Patent Number: 5,590,541

[45] Date of Patent: Jan. 7, 1997

[54] BARREL-TYPE REFRIGERATOR AND DRAIN PAN

[75] Inventor: Julius H. Rainwater, Conyers, Ga.

[73] Assignee: The Mead Corporation, Dayton, Ohio

[21] Appl. No.: 373,962

[22] Filed: Jan. 16, 1995

[51] Int. Cl.[6] ..... A47F 3/04

[52] U.S. Cl. ..... 62/255; 62/222; 62/289

[58] Field of Search ..... 62/255, 258, 279, 62/288, 289, 291

[56] References Cited

U.S. PATENT DOCUMENTS

| | | | |
|---|---|---|---|
| 2,909,907 | 10/1959 | Swanson | 62/279 X |
| 2,915,884 | 12/1959 | Haushalter et al. | 62/298 X |
| 3,111,818 | 11/1963 | Dolan et al. | 62/279 |
| 4,019,339 | 4/1977 | Anderson | 62/255 |
| 4,272,969 | 6/1981 | Schwitzgebel . | |
| 4,845,957 | 7/1989 | Richardson | 62/255 |
| 4,876,861 | 10/1989 | Tanaka et al. . | |
| 4,920,760 | 5/1990 | Muhlack | 62/255 |
| 4,979,377 | 12/1990 | Fievet et al. . | |
| 5,117,649 | 6/1992 | Mangini et al. | 62/258 X |
| 5,271,241 | 12/1993 | Kim . | |

*Primary Examiner*—William E. Tapolcai
*Attorney, Agent, or Firm*—Dinnin & Dunn, P.C.

[57] ABSTRACT

A barrel-type refrigerator system and drain pan for use in refrigerating food products. The barrel-type refrigerator system includes an upper food compartment, middle coil-fan compartment, and a lower compressor compartment. The barrel-type refrigerator system works by using a forced cooled air system which will force cold air through an irregularly shaped refrigerator product zone and having the same air returned to the coil-fan compartment. The system will be set upon a system of caster wheels such that it may be moved to any location of a store by one individual.

9 Claims, 3 Drawing Sheets

BARREL-TYPE REFRIGERATOR AND DRAIN PAN

BACKGROUND OF THE INVENTION

1. Field of the Invention

The present invention relates generally to a refrigeration apparatus and, more particularly, to a barrel-type refrigerator system with a drain pan.

2. Description of Related

Refrigeration systems have been around for numerous years. Refrigeration systems are based on either a compression system or an absorption system. The everyday household refrigerator uses a compressor based refrigeration system. This system takes a liquid and passes it through an evaporator which will evaporate the refrigerant liquid thus pulling heat from the refrigerator zone. This evaporated liquid is then passed through a condenser and converted back into a liquid where the heat is dispensed into the outer atmosphere.

U.S. Pat. No. 4,727,969 to Schwitzgebel discloses a method for refrigerating fresh products and keeping them fresh, and a refrigerator for carrying out such method. The Schwitzgebel patent uses a refrigerator for maintaining high humidity. This is accomplished by using oversized evaporator surfaces maintained at a frost-free temperature. Forced air is continuously passed over the evaporator and over a drip water dish within the refrigerator compartment. This compartment is then vented to the outside of the refrigerator to complete the refrigeration system.

Most refrigerators like the one described above are bulky large units which are nearly impossible for one person to move on their own. The refrigeration units grocery or supermarket stores use are large units usually bolted or permanently set within the store area. These refrigeration systems are also based on compressor style systems.

Supermarkets and/or grocery stores at times use temporary displays of refrigerated foods, the stores currently use an ice bucket type of set up. This is a system where ice is placed within a barrel or bucket and the product is temporarily stored on top of the ice to keep the product cold. This does not work well for frozen products because the ice can only keep the product frozen for a minimal amount of time. Therefore, there is a need in the art for a temporary moveable barrel-type refrigerator which can be moved from location to location and can be used to refrigerate a food product and/or freeze a food product. This type of system will remove the messy spills of ice based systems and will enable grocers to have displays of food at any location.

SUMMARY OF THE INVENTION

One object of this invention is to provide a novel barrel-type refrigeration system with a drain pan for use in the home and/or in grocery stores.

Another object of the invention is to provide a portable-type food display which does not use ice as its main cooling feature.

Another object of the present invention is to provide a larger system for displaying food products at temporary locations.

Another object of the present invention is to provide a low maintenance, mess-free system which does not use ice and/or water to produce the cooling effect for food.

To achieve the foregoing objects the barrel-type refrigerator system and drain pan includes three separate compartments for the refrigeration system. The food compartment is where the refrigerated food products are placed for display in the system. The second compartment includes an evaporator coil and blower fan which move the cooled air throughout the food product zone. The third compartment and lowest compartment in the refrigerator system includes the condenser and compressor unit and the drain pain which sits atop of the compressor unit for quick evaporation of any condensate. The entire barrel system is set upon casters to enable easy moving by one individual. The barrel-type refrigerator system also includes a double-pane plexiglass lid.

One advantage of the barrel-type refrigerator system is that it is a more sanitary system then the previously used ice systems.

Another advantage of the barrel-type refrigerator system is that more volume can be used to display food products than previously done in the old ice systems.

Another advantage of the barrel-type refrigerator system is that there is no waste water to clean up and/or empty from melting ice.

Another advantage of the barrel-type refrigerator system is that it is easily moveable by one individual and can be placed at different locations throughout the store.

Yet another advantage of the barrel-type refrigerator system is the low amount of condensate which forms on the evaporator and/or condenser and that the condensate which does form is placed within a drain drip pan located on top of the hot compressor unit.

Still another advantage of the barrel-type refrigerator system is that the drip drain pan includes an overflow spout which will direct any overflow condensate liquid onto the floor of the unit and not onto the electronics of the compressor unit or refrigerator system.

Other objects, features and advantages of the present invention will become apparent from the subsequent description and appended claims taken in conjunction with the accompanying drawings.

Figure 1:
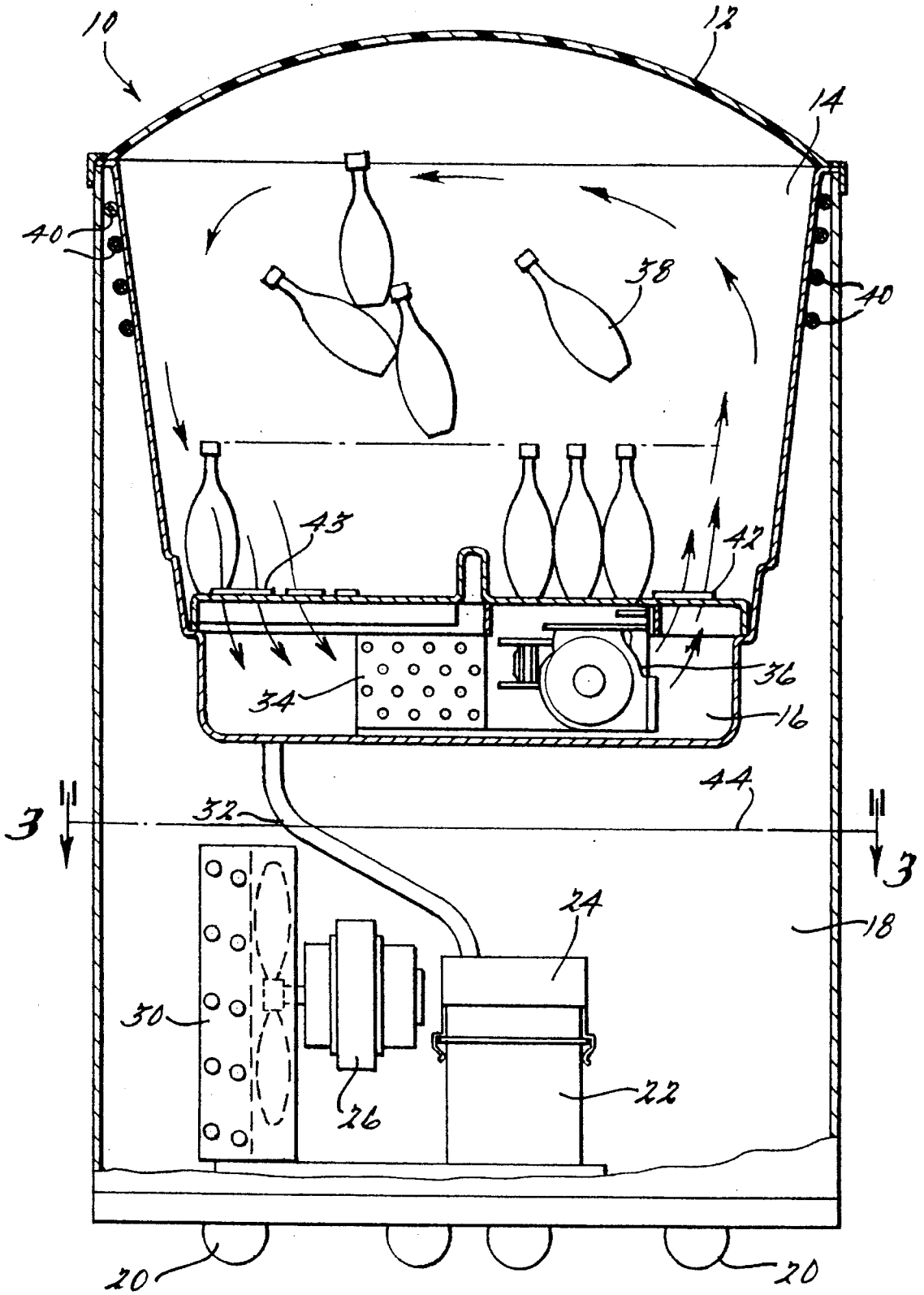
FIG. 1 shows an overall view of the barrel-type refrigerator system and drain pan.
Figure 2:
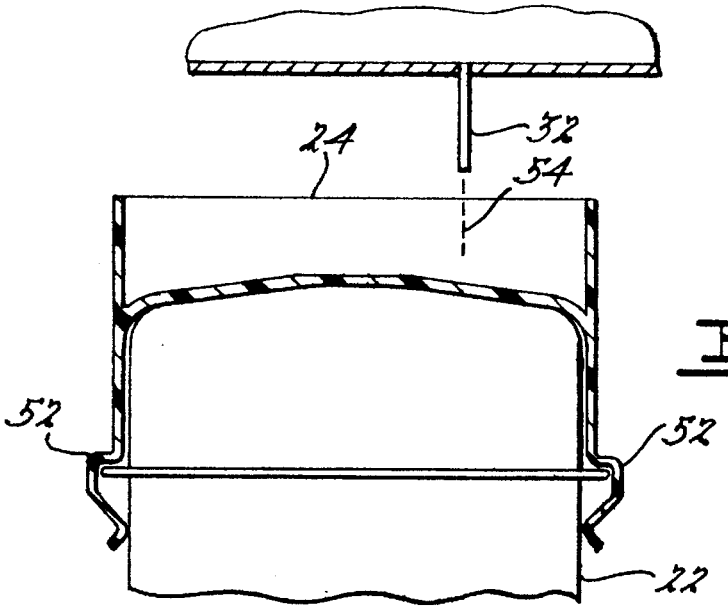
FIG. 2 is a view of the drain pan and its configuration upon the compressor unit.

BEST MODE OF CARRYING OUT THE INVENTION AND DESCRIPTION OF THE PREFERRED EMBODIMENT(S)

The barrel-type refrigerator system 10 and drain pan 24 is a device that is used as a temporary or local refrigeration unit for displaying food products 38. The system does not use ice like the previous systems and is based on a compression system refrigeration unit. The barrel-type refrigerator 10 includes three separate compartments within its structure.

The first compartment is the food zone area 14 where the refrigerated food products are placed and are insulated via a double-pane plexiglass lid 12 at the top. The second compartment directly below the food zone compartment 14 and hidden by a false bottom 60 is the coil fan compartment 16. The evaporator 34 is located within the second compartment 16 along with a blower type fan 36 for use in moving and forcing the cold air through the refrigerated product zone 14. Directly beneath the coil-fan compartment 16 and at the bottom of the barrel type refrigerator 10 is the condenser and compressor compartment 18. This compartment 18 houses the condenser 30 and the compressor 22 along with the drain pan 24 which is placed directly on top of the compressor 22. The entire system 10 is placed upon a rolling caster wheel system 20 so that the barrel-type refrigerator 10 may be moved easily by one individual. The barrel-type refrigerator system 10 also includes a louvered panel which gives accessibility to the internal electronics of the refrigerator system 10.

FIG. 1 shows the overall barrel-type refrigerator system 10. The upper compartment or the refrigerator food zone compartment 14 has a generally U-shaped cross-section however it should be noted that the barrel-type refrigerator 10 may take the shape of a square, circle, octagonal, or any other shape necessary for the food storage unit. The food zone compartment or upper compartment 14 also has a plexiglass lid 12 which is double-pane to reduce condensation upon the lid 10 and for easy viewing of the food products 38. The upper compartment 14 is surrounded by a plurality of wraparound coils 40 placed located at the upper edge of the compartment 14. These wraparound coils 40 are placed such that they give a frost feel on the inner surface of the food compartment. The coils 40 are wrapped in an insulation material on the outside so as not to refrigerate the entire empty space between the food compartment 14 and the lower compartment 18. The wraparound coils 40 also assist in creating a cold atmosphere for the food products 38. The insulation used on the outer part of the wraparound coils 40 is a loam insert type insulation, however, any other type of insulation may be used as required.

A second compartment 16 is located directly adjacent to and below the food product compartment 14. The second compartment 16 is separated from the food product compartment 16 by a false bottom 60. Within this second compartment 16 is an evaporator coil 34, this evaporator coil 34 is the traditional finned-type coil, however any other type of evaporator coil may be used. Also included within this second compartment 16 is a blower fan mechanism 36 which is used to blow the cool or cold air up through the product zone or food compartment 14. The second compartment 16 includes a reservoir which will allow any evaporated water or $H_2O$ condensate 54 to drain down through a drain conduit 32 to the drip drain pan 24 in the lower compartment 18.

Figure 4:
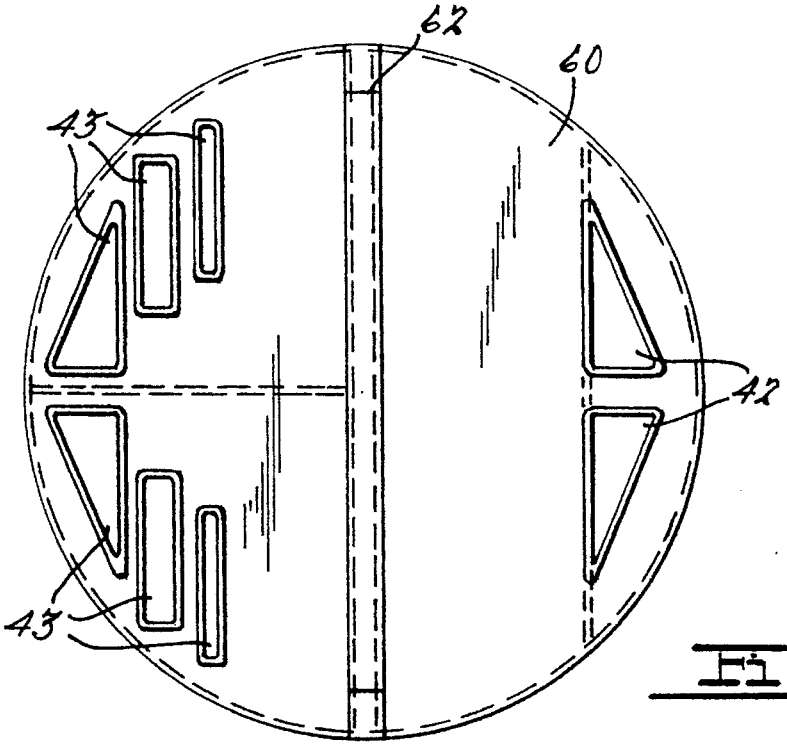
FIG. 4 is a view of the false panel bottom of the barrel-type refrigerator system which includes the air duct orifices.
Figure 5:
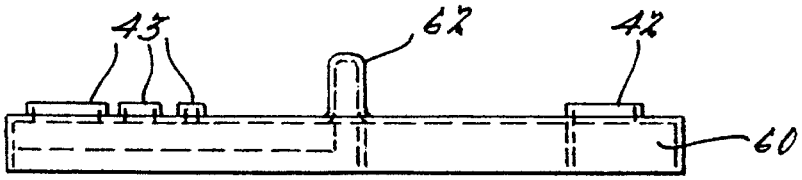
FIG. 5 is a side view of the false bottom of the food product zone.

FIGS. 4 and 5 show the false bottom 60 which is placed between the food compartment 14 and the coil-fan or second compartment 16. The false bottom 60 includes a series of orifices (42, 43) within its body which allow for the flow of forced air through the product zone 14 and returned through the same false bottom 60 to the coil-fan compartment 16. The preferred embodiment includes two triangular orifices 42 placed at one end of the circular false bottom 60, it should be noted that the false bottom 60 may take any shape necessary to fill the entire shape of the barrel-type refrigerator system 10. The triangular orifices 42 allow the forced air to be spread throughout the entire food product area and to surround all of the food products 38. The air is then forced back through the outer or air return orifices 43. The air return orifices 43 include two triangular orifices and four rectangular orifices which will return the air to the coil-fan or second compartment 16. It should be noted that the shapes and sizes of the air return and inlet air orifices may be changed to any appropriate shape as necessary for the food products to be used. The false bottom 60 also includes a raised projection 62 across its entire length separating the air return orifices 43 from the air input orifices 42. The orifice patterns create such a flow that all the food products 38 will be maintained at a certain temperature depending on the temperature chosen by the user.

Figure 3:
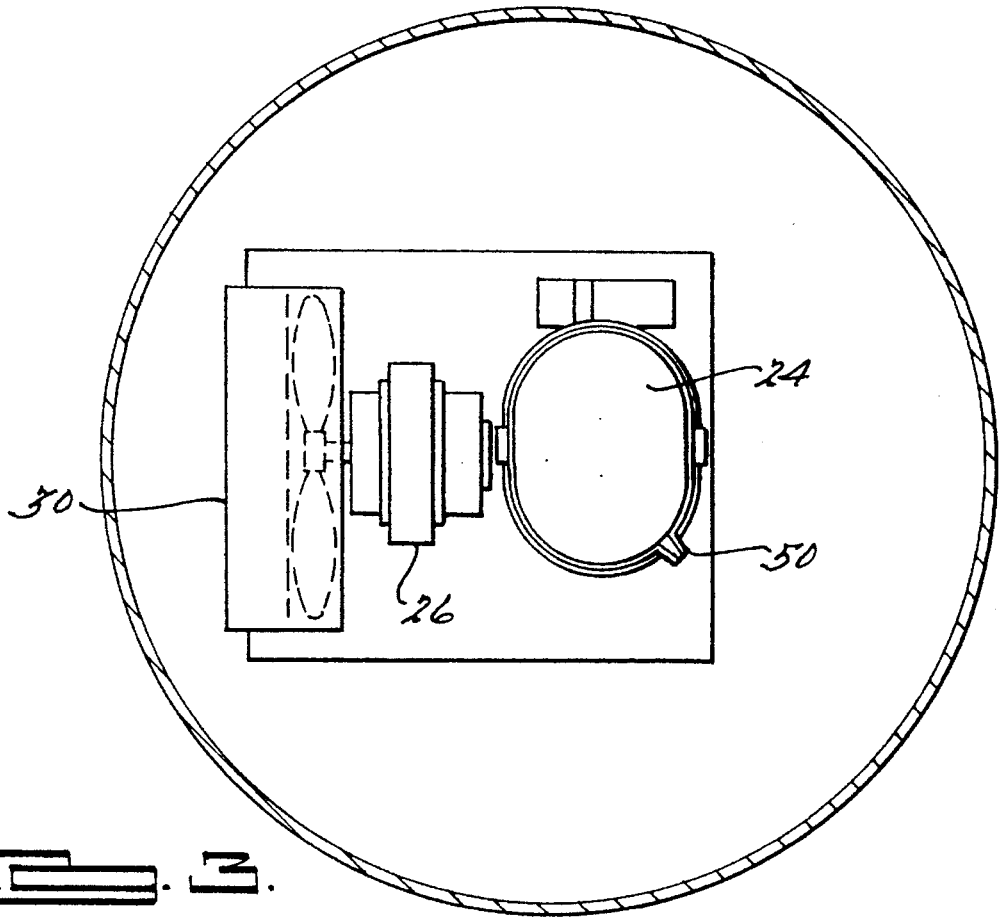
FIG. 3 is a top view of the barrel-type refrigerator system.
Figure 6:
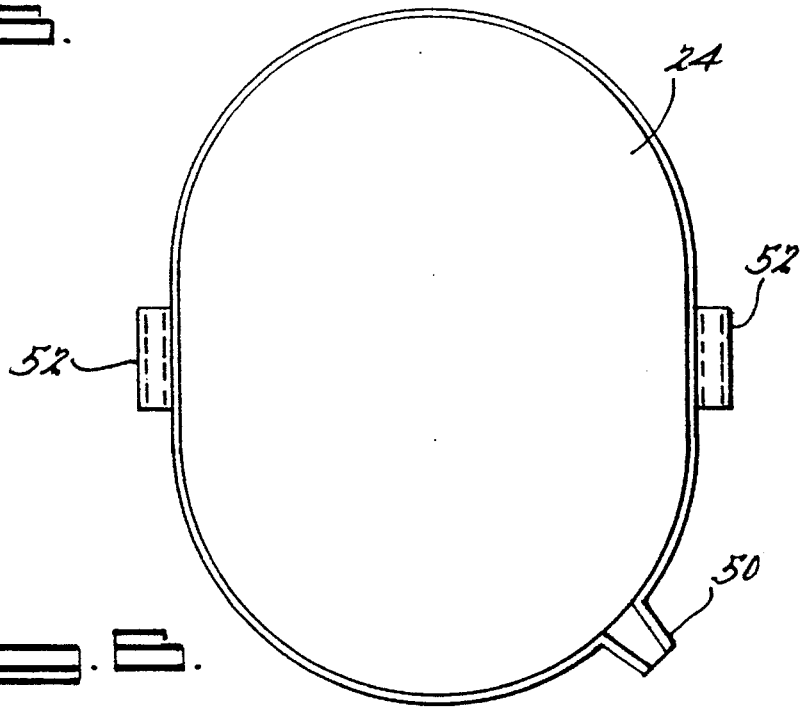
FIG. 6 is a top view of the drain pan for use on the compressor.

FIG. 1, FIG. 3, and FIG. 6 show the lower compartment or condenser compartment 18 of the barrel-type refrigerator system 10. The lower compartment 18 is directly adjacent to and below the second compartment or coil-fan compartment 16. The lower compartment 18 includes the condenser unit 30, a fan unit 26, the motor compressor 22, and the drain drip pan system 24. The drain pan 24 is set up such that the water drainage tube 32 from the coil-fan compartment 16 is directed into the drain pan 24. The drain pan 24 is placed directly on the compressor motor housing unit 22. The compressor housing unit 22 is then placed within the stream of air from the fan 26 which is used to cool the condenser unit 30. The air from the condenser unit fan 26 is blown across the drain pan 24 and motor compressor unit 22 and exited through the bottom of the barrel-type refrigerator 10. The lower compartment 18 is separated from the upper two compartments by an insulated wall 44 such that the heat of the compressor unit 22 does not interfere with the product temperature of the refrigerated product zone 14. The compressor 22 is capable of cycling, this allows the refrigerated compartment 14 to have a large temperature range from a cool temperature to having the food products frozen. A control system is used to cycle the compressor 22 which will avoid freezing non-frozen food products such as beverages. The control system can cycle the compressor 22 on and off long enough that it will melt any ice buildup on the cooling coil 34 to avoid icing and blocking the air flow into the refrigerated food products zone 14. The barrel refrigerator system 10 uses a louvered panel in order to provide easy accessibility to the thermostat, the fuse, and the power receptacle of the barrel refrigerated unit 10.

The drain pan 24 which is used in the barrel-type refrigerator system is shown in FIG. 6. The drain pan 21 will match the shape of the compressor unit 22. In our preferred embodiment, the drain pan 24 has an oval shape and includes an overflow spillage spout 50 on one end thereof. The drain pan 24 also includes a curved bottom portion such that the water will tend to flow into the corners of the crowned shape drain pan 24. The drain pan 24 is snugly placed upon the top of the compressor unit 22 and held in place with friction latches 52. These friction latches 52 have an S-like cross-section to securely fasten around the compressor unit 22. The drain pan 24 will collect and store condensate from the refrigeration cycle. Any overflow of condensate or water from the refrigeration cycle will be funneled through the overflow spout 50 onto the floor of the supermarket store instead of on the electronics of the refrigeration system. The drain pan 24 operates by using the heat of the compressor 22 to evaporate most if not all of the waste water. The heat is created by the compressor motor 22 running. The drain pan 24 is placed within the air stream of the condenser fan 26 which will also further the evaporation of any waste water collected in the drain pan 24. The drain pan 24 is sized to collect the normal condensate from the cooling coil inside of the refrigerator without overflowing.

The drain pan 24 is placed below the evaporator compartment 16 to allow for a natural flow of water down the tube 32 into the drain pan 24. Most of the condensate from the refrigerator is formed in the cooling coil area 34 and released by defrosting.

The barrel-type refrigerator 10 uses a system of caster wheels 20 on its bottom surface such that one person may easily move and relocate the barrel refrigerator 10 anywhere within a store.

In operation the barrel-type refrigerator system 10 uses any type of refrigerant which is available today. The refrigerant will be pumped by the compressor 22 through the condenser 30 up into the evaporating coil 34 where it will evaporate. This evaporation of the refrigerant liquid will draw heat from the refrigerated food product zone 14. Next the evaporated refrigerant will be returned to the condenser 30 where it will be recondensed into a liquid. The heat will then be dispensed across the drain drip 24 pan and into the outer atmosphere. The evaporator coil 34 will have a fan blower 36 located adjacent to it such that it will blow the cool or cold air through the outlet air orifices 42 into the refrigerated food product zone 14. The forced air will surround the irregular shaped food products 38 and then return via the forced air outlet orifices 43 back to the evaporator compartment 16 where it will be re-cooled and sent back into the refrigerated product zone 14. The condensate and frost that forms on the evaporator coil 34 from the refrigeration cycle will periodically be melted such that the waste water will be drained through the drain conduit 32 into the drain pan 24 for evaporation by the heat of the compressor unit 22 and the air flow from the condenser fan 26. The defrost cycle will occur by cycling the compressor unit 22 with the electronics of the refrigerator control system. The cycling of the compressor 22 is also used to keep refrigerated products from freezing, such as beverages. It should also be noted that products may be kept in a frozen state within the barrel-type refrigerator 10.

The entire system is controlled by an electronic control system that allows the user to choose a specific temperature. Electricity controls the barrel-type refrigerator 10 from frozen to refrigerated settings. The barrel-type refrigerator 10 may be placed around a store or in a home such that food products may be displayed at temporary locations.

The present invention has been described in an illustrative manner, it is to be understood that the terminology which has been used is intended to be in the nature of words of description rather than of limitation.

Many modifications and variations of the present invention are possible in light of the above teachings. Therefore, within the scope of the appended claims the present invention may be practiced otherwise than as specifically described.

What is claimed is:

1. A refrigerator and drain pan system, including:

a refrigerated food product zone for holding a food product, said food product zone includes a clear insulated lid;

a system of cooling coils to cool the food product zone to a predetermined temperature, said cooling system includes wraparound coils and a finned coil system, said wraparound coils create a frost-feel at the top edge of the food product zone;

a coil-fan compressor compartment located adjacent and below the refrigerated food product zone, said coil-fan compartment is separated from the product zone by a false panel;

a compressor compartment located adjacent to and below the coil-fan compartment, said compressor compartment being separated from said coil-fan compartment by an insulated shelf;

a plurality of orifices located within said false panel to move air through said refrigerated product zone, said plurality of orifices include inlet orifices and air return orifices, said inlet orifices force air through the product zone and around the products, said air is returned to said coil fan compartment by the return orifices;

an electronic control system for controlling cycling of a compressor and all electronic functions of the system:

a drain conduit from said fan compartment to said compressor compartment; and a drip pan system for evaporating water condensate within the system, said drip pan system including a drain pan located in an air flow of a condenser, said drain pan system including an overflow spout such that any overflow condensate will reach the floor and avoid the electronics of the refrigerator system, said drain pan is placed in close proximity to a compressor motor.

2. The refrigerator and drain pan system of claim 1 further including a caster wheel system.

3. The refrigerator and drain pan system of claim 1 wherein said air is forced through the refrigerated product zone via a fan and blower mechanism.

4. The refrigerator and drain pan system of claim 1 wherein said inlet orifices and air return orifices have predetermined shapes in order to prevent food products from blocking said orifices.

5. The refrigerator and drain pan system of claim 4 wherein said inlet orifices have the shape of a right triangle.

6. The refrigerator and drain pan system of claim 4 wherein said air return orifices include the shapes of a right triangle and a rectangle.

7. The refrigerator and drain pan system of claim 1 wherein said drain pan is crowned so any condensate will collect in corners of said drain pan.

8. The refrigerator and drain pan system of claim 1 wherein said drain pan includes a friction latch to secure it on top of the compressor.

9. A barrel-type refrigerator and drain pan system, said system including:

a refrigerated food product zone for holding a food product;

a coil-fan compartment adjacent to and below said product zone, said coil-fan compartment separated from said product zone by a false panel, said coil-fan compartment including an evaporator coil and a fan;

a compressor compartment adjacent to and below said coil-fan compartment, said compressor compartment including a condenser, a fan, a compressor, and a drain pan system, said drain pan system including a drain pan, located in an air flow of said condenser;

a plurality of orifices located within said false panel, said orifices force the flow of air from the coil-fan compartment around the food product and back to the coil-fan compartment;

said drain pan is located on top of said compressor, said drain pan is round, said drain pan includes an overflow spout; and a caster wheel system located on the bottom of said system for use in moving said system.

* * * * *